US012773610B2

(12) United States Patent
Rody et al.

(10) Patent No.: US 12,773,610 B2
(45) Date of Patent: Oct. 27, 2026

(54) METHOD AND DEVICE FOR HOCKEY PUCK FACE-OFF TRAINING

(71) Applicants: Vaughan Rody, Lake Stevens, WA (US); James Roy, Costa Mesa, CA (US)

(72) Inventors: Vaughan Rody, Lake Stevens, WA (US); James Roy, Costa Mesa, CA (US)

(73) Assignees: Vaughan Rody, Lake Stevens, WA (US); James Roy, Costa Mesa, CA (US)

( * ) Notice: Subject to any disclaimer, the term of this patent is extended or adjusted under 35 U.S.C. 154(b) by 296 days.

(21) Appl. No.: 18/751,264

(22) Filed: Jun. 23, 2024

(65) Prior Publication Data

US 2025/0001272 A1 Jan. 2, 2025

Related U.S. Application Data

(60) Provisional application No. 63/524,682, filed on Jul. 2, 2023.

(51) Int. Cl.
*A63B 69/00* (2006.01)
*A63B 71/06* (2006.01)

(52) U.S. Cl.
CPC ..... *A63B 69/0026* (2013.01); *A63B 71/0622* (2013.01); *A63B 2071/0625* (2013.01);
(Continued)

(58) Field of Classification Search
CPC ..... A63B 69/0026; A63B 71/0622; A63B 2071/0625; A63B 2071/0694;
(Continued)

(56) References Cited

U.S. PATENT DOCUMENTS 3,665,910 A * 5/1972 Boni ..... A63B 69/40 124/73
3,794,318 A 2/1974 Holmes
(Continued)

FOREIGN PATENT DOCUMENTS

CA 2141904 8/1996
CA 2399594 2/2004
(Continued)

OTHER PUBLICATIONS

Bruchanski, B., et al., "Design of a Hockey Face-Off Simulator: Final Design Report," Dec. 7, 2015, 84 pages.
(Continued)

*Primary Examiner* — Nini F Legesse
(74) *Attorney, Agent, or Firm* — CHRISTENSEN O'CONNOR JOHNSON KINDNESS PLLC

(57) ABSTRACT

A hockey puck face-off training device and method are provided. The hockey faceoff practice device includes a hopper-style feeder capable of holding hockey pucks. The hopper-style feeder ensures a constant supply of the hockey pucks during a hockey faceoff training. The device includes a gripper hand configured to pick and hold a hockey puck supplied from the hopper-style feeder, and release the puck in a randomized manner after being extended to a threshold distance away from the hopper-style feeder or the hockey faceoff practice device. The device further includes a means for retracting the gripper hand back to the hockey faceoff practice device after the release of the puck.

20 Claims, 7 Drawing Sheets

(52) U.S. Cl.
CPC ... *A63B 2071/0694* (2013.01); *A63B 2210/50* (2013.01); *A63B 2214/00* (2020.08); *A63B 2225/093* (2013.01)

(58) Field of Classification Search
CPC ..... A63B 2210/50; A63B 2214/00; A63B 2225/093; A63B 2225/09
USPC ..... 473/422, 431, 446; 124/11, 13 R, 13 A, 124/30 R, 45
See application file for complete search history.

(56) References Cited

U.S. PATENT DOCUMENTS

| | | | | |
|---|---|---|---|---|
| 3,876,201 | A * | 4/1975 | King | A63B 69/0026 124/47 |
| 4,070,017 | A | 1/1978 | Toronto | |
| 4,105,203 | A | 8/1978 | Cho | |
| 4,749,189 | A | 6/1988 | Frank | |
| 5,069,451 | A * | 12/1991 | Martens | A63B 47/002 124/79 |
| 5,407,198 | A | 4/1995 | Morrow et al. | |
| 5,470,067 | A | 11/1995 | Diresta | |
| 5,846,144 | A * | 12/1998 | Bothers | A63B 47/002 473/446 |
| 6,514,162 | B1 | 2/2003 | Karellas | |
| 6,647,975 | B2 | 11/2003 | Whitfield | |
| 6,884,186 | B2 * | 4/2005 | Fluckiger | A63B 69/40 124/16 |
| 7,121,964 | B1 | 10/2006 | Dahm | |
| 7,766,770 | B2 | 8/2010 | Cucjen et al. | |
| 8,287,404 | B2 | 10/2012 | Cucjen et al. | |
| 8,932,155 | B2 | 1/2015 | Moore | |
| 9,266,002 | B2 | 2/2016 | Dunser | |
| 9,517,390 | B1 | 12/2016 | Duffy | |
| 9,750,988 | B1 | 9/2017 | Auld et al. | |
| 11,660,517 | B2 * | 5/2023 | Bear | A63B 21/023 473/446 |
| 2011/0077108 | A1 | 3/2011 | Gulka | |
| 2015/0045155 | A1 | 2/2015 | Chen | |
| 2021/0038965 | A1 * | 2/2021 | Shirley | A63B 69/0026 |

FOREIGN PATENT DOCUMENTS

| | | |
|---|---|---|
| CA | 2481818 | 3/2006 |
| CN | 208990191 | 6/2019 |
| KR | 101907131 | 10/2018 |
| KR | 20180112605 | 10/2018 |
| KR | 20180112733 | 10/2018 |
| RU | 2714770 | 2/2020 |

OTHER PUBLICATIONS

WinMill, "100mph Portable Puck Cannon for Hockey Players and Goalies," 21 separate video stills from video on YouTube.com <https://www.youtube.com/watch?v=woO9i7OcAVY [retrieved Jul. 28, 2020].

Potent Hockey, "Potent Super Hockey Defender Hockey Trainer—Puck Control," Amazon Website, Jun. 28, 2020, 5 pages.

* cited by examiner

METHOD AND DEVICE FOR HOCKEY PUCK FACE-OFF TRAINING

CROSS-REFERENCE TO RELATED PATENT DOCUMENTS

This patent application claims the benefit of priority of U.S. Provisional Patent Application No. 63/524,682, entitled "METHOD AND APPARATUS FOR HOCKEY PUCK FACE-OFF TRAINING," filed Jul. 2, 2023, which is incorporated herein by reference in its entirety.

TECHNICAL FIELD

The present invention relates generally to dropping a hockey puck, and more particularly, to a method and device related to dropping a hockey puck between two players to train them on a hockey face-off such as in ice hockey and other different variants of floor hockey.

BACKGROUND

Puck possession is the key factor in winning hockey games. Faceoffs play a crucial role in the sport of hockey, for example, ice hockey. A faceoff in ice hockey is when two players from opposing teams line up head-to-head, and the referee drops the puck in between both players. From there, each player uses their hockey stick to try to win possession of the puck for their team. Faceoffs happen at the beginning of the game/each period or following any stoppage of play. This also includes penalties, offsides, icings, goals scored, and so on. At the beginning of the period or game, or after a goal, the faceoff will always occur at center ice. When the puck touches the ice, the faceoff is officially over (and the play clock resumes). Hockey players, especially centers, require rigorous practice to develop their faceoff techniques, timing, and decision-making abilities. Traditionally, faceoff training involved repetitive drills with a coach or another player manually dropping pucks. However, this method of training is often time-consuming, impractical for individual training, and lacks the element of unpredictability crucial for simulating game-like conditions.

Traditional faceoff training devices that have been used to overcome these challenges are found to be bulky, and non-portable, thereby limiting their acceptance amongst hockey players. One of the limitations of conventional devices is their reliance on an external power source. These conventional devices typically need to be connected to the external power source using a power cord, which hampers their convenience and portability. At a typical ice hockey rink, the nearest power source may be located far away from the face-off position, resulting in a cumbersome arrangement of lengthy power cords across the playing surface. Moreover, in certain practice locations, an external power source may not be readily available, rendering these devices unusable and impractical to deploy.

Another common approach involves the use of some mounting devices to a fixed support structure, such as a wall. However, these wall-mounted devices present several shortcomings and fail to accurately simulate real face-off situations that typically occur away from the walls of an ice rink. One significant drawback associated with the use of these devices is the difficulty in moving them. Due to their fixed nature, considerable effort is often required to relocate these devices, limiting their versatility, and hindering their usage in different training locations. Moreover, certain ice hockey rink facilities, particularly those owned by government agencies, may have their regulations and thus will prohibit the mounting of these devices on their walls, even if they are to be mounted temporarily. This restricts the availability of practice equipment for players and coaches.

Furthermore, devices mounted near a wall fail to replicate the true dynamics of face-offs happening in the sport of hockey or ice hockey that usually occur away from the wall. Face-offs in actual gameplay involve strategic positioning and movement, which can be obstructed by a wall-mounted device. By limiting the players' face-off options and restricting their movements, these wall-mounted devices do not accurately simulate realistic face-off scenarios. Another drawback associated with some conventional training devices known in the art is their instability. Certain devices include bases that are not sufficiently large or sturdy to maintain stability during face-offs. As players engage in a scramble to control the released puck, these conventional unstable devices can easily tip over, disrupting the face-off process. In addition to interfering with the training session, a lack of stability in such conventional devices can lead to inconsistent puck drops, resulting in undesirable outcomes. For instance, a hockey puck may be released at a non-flat angle due to instability, causing it to take a peculiar bounce off the playing surface. Such unpredictable bounces can introduce biases and unfair advantages for one player over another.

Further, several inventors in the past have proposed training devices for hockey players for example, U.S. Pat. No. 10,272,311 discloses an apparatus that includes a stationary frame configured to remain grounded with a weight holder with weights to ensure the frame remains stable on the ground during the use of the apparatus. Further, the apparatus of U.S. Pat. No. 10,272,311 includes an impact member connected to the frame with a movable joint. The players are prompted to use their stick with the blade and hit the puck to overcome the resistance force exerted by the impact member. The apparatus as disclosed is useful for training hockey players to gain access to the puck during face-off. Additionally, U.S. Pat. No. 10,737,161 discloses a hockey puck rebounder and training device capable of rebounding hockey pucks. The training device includes a rigid frame (e.g. a tubular metal frame) capable of deflecting hockey pucks with substantially no permanent deformation of the training device. The apparatus of U.S. Pat. No. 10,737,161 is aimed at providing training to players to practice shooting, passing, receiving, etc. Although, in the past few years training devices that may be useful for hockey players are being proposed by the increased number of inventors, there have not been significant improvements specifically when it comes to training hockey players for face-off situations except a few that have several shortcomings as discussed above.

Although different methods and apparatuses have been proposed in the past for dropping a hockey puck to facilitate, stimulate, or train players for a hockey face-off, such methods and apparatuses have their shortcomings or limitations as discussed above. Thus, there still exists a need for a more reliable solution that may be comparatively lightweight, portable, and easy to use at any chosen hockey rink facility and can be effectively used for training a hockey face-off.

SUMMARY

It will be understood that this disclosure is not limited to the particular systems, and methodologies described, as there can be multiple possible embodiments of the present disclosure which are not expressly illustrated in the present disclosure. It is also to be understood that the terminology used in the description is for the purpose of describing the particular versions or embodiments only and is not intended to limit the scope of the present disclosure.

Embodiments of the present invention provides a system, method, and device for dropping a puck between players to facilitate, stimulate, or train them for a hockey face-off. According to an aspect of the present invention, there is provided a hockey faceoff practice device. The device incudes a hopper-style feeder capable of holding one or more hockey pucks there inside, wherein the hopper-style feeder ensures a constant supply of the hockey pucks during hockey faceoff training.

According to the same aspect, the device further comprises a gripper hand configured to pick and hold a hockey puck of the one or more hockey pucks supplied from the hopper-style feeder, and release of the puck in a randomized manner after being extended to a threshold distance away from the hopper style feeder or the hockey faceoff practice device.

According to the same aspect, the device further comprises a means for retracting the gripper hand back to the hockey faceoff practice device after the release of the puck. The means comprises at least one of: an actuator, and a motor.

According to the same aspect, the puck fed to and held by the gripper hand is loaded therein by a puck placing module.

According to the same aspect, the puck held by the gripper hand is released by a puck release module in synchronization with timing control from a processor in communication with a control module configured on the hockey faceoff practice device.

According to the same aspect, the gripper hand is extended to the threshold distance away from the hopper-style feeder or the desired distance from a faceoff dot utilizing an extendable arm. The extendable arm is extendable via cables and motor/pulley mechanisms to control the speed of extension/retraction of the extendable arm. the extendable arm is configured to extend the gripper hand to a distance spanning from 2 feet to 5 feet.

According to the same aspect, the hockey faceoff practice device is adapted to operate in at least one of: a manual mode allowing dispensing of a single puck upon pushing a button present on the control module, and an automatic mode enabling continuous dispensing of the pucks at time intervals selectable by a user.

According to the same aspect, the hockey faceoff practice device comprises a tripod structure and/or a four-legged structure. The tripod structure and/or a four-legged structure comprises fixed-length legs or height-adjustable legs.

According to one embodiment, the gripper hand comprises a spring-loaded gripper configured to securely pick, hold, and release the puck when the faceoff practice device is activated to function.

According to another embodiment, the gripper hand comprises at least one fixed finger, and at least one openable finger. The at least one fixed finger remains stationary and provides a stable support for the puck held by the gripper hand, and the at least one openable finger is configured to move or pivot, allowing for loading, and release of the puck in the gripper hand. The at least one fixed finger and the at least one openable finger of the gripper hand are solenoid-controlled fingers. The gripper hand further comprises a spring-loaded upper finger to induce a downward force on the puck when released. The upper finger is connected to a cam roller that rolls to a random position with each loading of the puck.

According to the same aspect, the gripper hand comprises an indicator configured to provide visual or auditory feedback to the user to indicate the device's status, mode selection, or countdown for puck releases.

According to the same aspect, the faceoff practice device is made to operate as an application control system operated using a user computing device.

According to another aspect, a method for hockey faceoff training using a hockey faceoff practice device includes the steps of: loading one or more pucks into a hopper-style feeder located on the body of the hockey faceoff practice device; picking and holding of at least one puck by a gripper hand supplied from the hopper-style feeder; pushing a single puck into the gripper hand for a secure holding; moving and placing the gripper hand at a threshold distance away from the hopper-style feeder by an extendable arm; releasing the puck securely held by the gripper hand after full extension of the extendable arm; and retraction of the extendable arm back into the hockey faceoff practice device after the release of the puck.

These and other features, aspects, and various advantages of the present invention will become apparent from the detailed description below, in light of the accompanying drawings.

DETAILED DESCRIPTION

Figure 1:
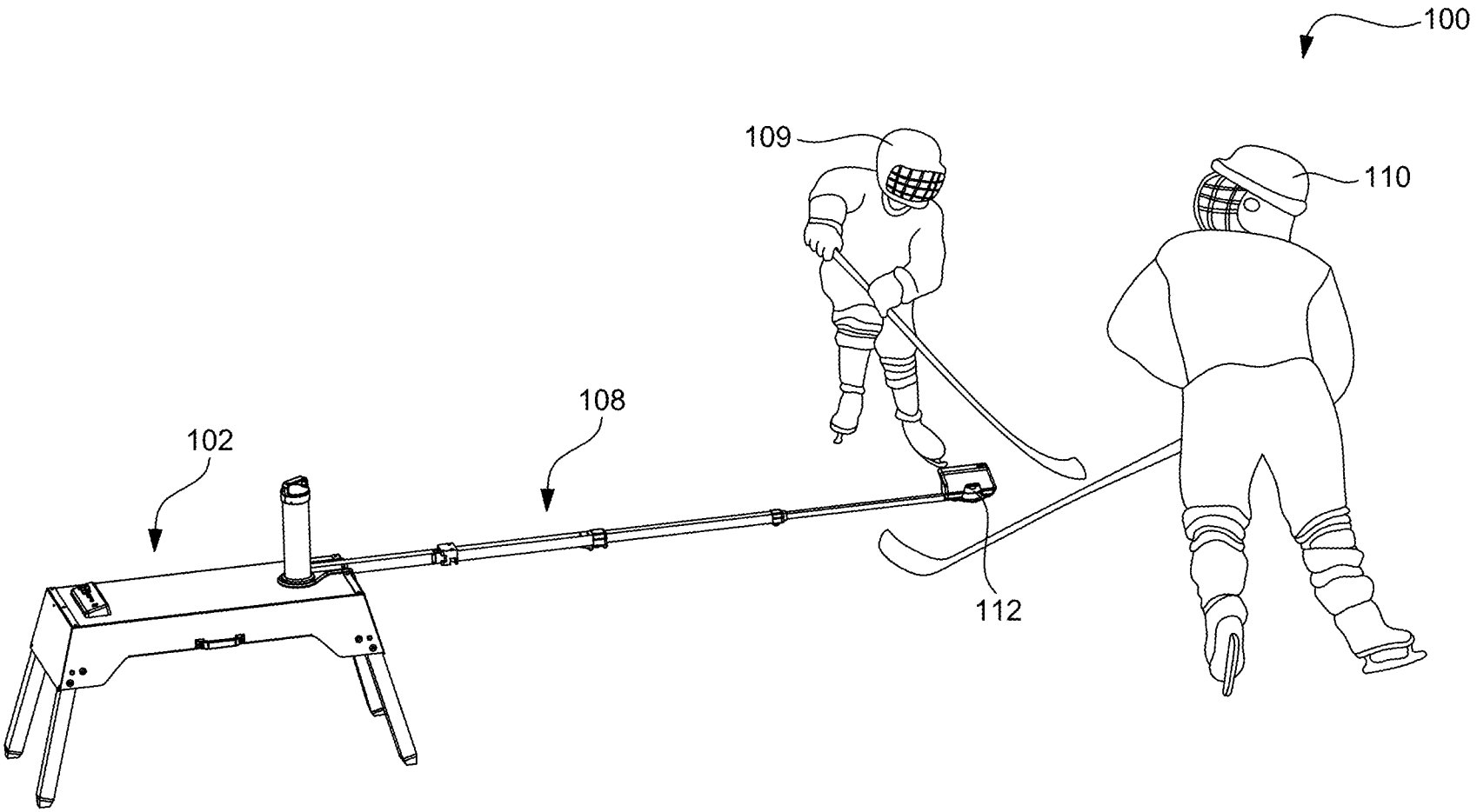
FIGS. 1-2 illustrates a general implementation of dropping a puck in between two players during a hockey face-off training, according to an exemplary embodiment of the present invention.

As used in the specification, the singular forms "a", "an" and "the" may also include plural references. For example, the term "an article" may include a plurality of articles. Those with ordinary skill in the art will appreciate that the elements in the figures are illustrated for simplicity and clarity and are not necessarily drawn to scale. There may be additional components or processes described in the foregoing application that are not depicted on the described drawings. In the event such a component or process is described, but not depicted in a drawing, the absence of such component and process from the drawings should not be considered as an omission of such design from the specification.

Before describing the present invention in detail, it should be observed that the present invention utilizes a combination of components or processes, which constitutes a system, device, and method for dropping a puck between two players to facilitate, simulate, or train them for a hockey face-off. Accordingly, the components or processes have been represented, showing only specific details that are pertinent for an understanding of the present invention so as not to obscure the disclosure with details that will be readily apparent to those with ordinary skill in the art having the benefit of the description herein. As required, detailed embodiments of the present invention are disclosed herein; however, it is to be understood that the disclosed embodiments are merely exemplary of the invention, which can be embodied in various forms. Therefore, specific component level details and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

References to "one embodiment", "an embodiment", "another embodiment", "one example", "an example", "another example", "yet another example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment. The words "comprising", "having", "containing", and "including", and other forms thereof, are intended to be equivalent in meaning and be open-ended in that an item or items following any one of these words is not meant to be an exhaustive listing of such item or items or meant to be limited to only the listed item or items. Further, the word "user", "player", and "person" are used interchangeably in the description.

The system, method, and apparatus for dropping a puck in between players to train them for hockey face-off will now be described with reference to the accompanying drawings, particularly FIGS. 1-10.

Figure 2:
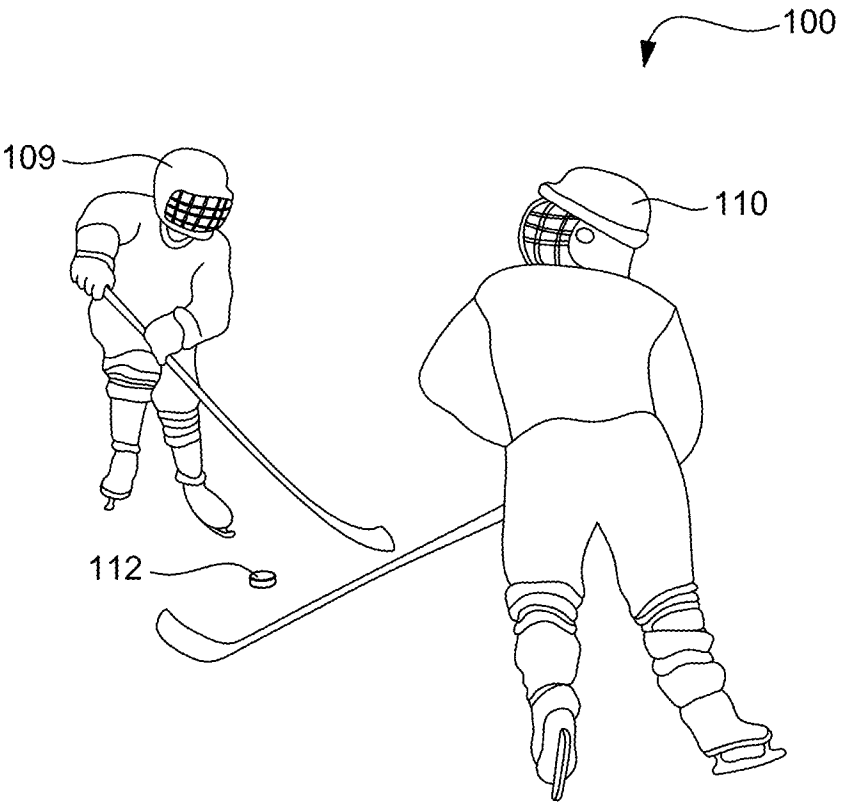
Figure 2:
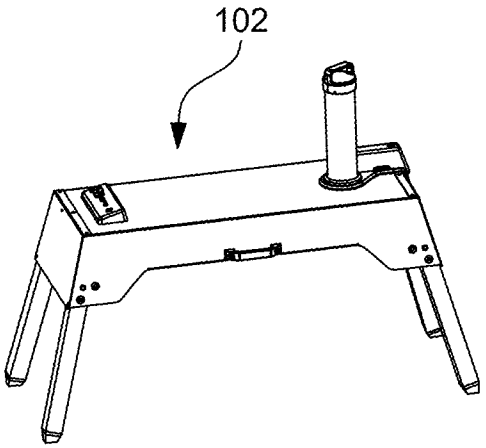

Referring to FIGS. 1 and 2 in conjunction with FIGS. 3-10, illustrate a general implementation of a system 100 for dropping a puck in order to facilitate, stimulate, or train players for a hockey face-off is shown, in accordance with an exemplary embodiment of the present invention. The system 100 includes a faceoff practice device 102, a puck 104, and two players 110 and 112 lined up head-to-head for a face-off training.

As traditionally known, a referee usually drops the puck in between both players from opposing teams. From there, each player uses their hockey stick to try to win possession of the puck for their team. The faceoffs happen at the beginning of the game/each period or following any stoppage of play. To enhance the faceoff handling skills in players, the current system 100 provides the faceoff practice device 102 that replaces the referee which would otherwise drop the puck between players in an actual game of hockey during faceoffs. The faceoff practice device 102 is a versatile and portable apparatus useful for enhancing faceoff skills in team sports like hockey or ice hockey and other different variants of floor hockey. The faceoff practice device 102 incorporates several features to simulate game-like scenarios and provide a customizable training experience to players. The faceoff practice device 102 is preferably made as a four-legged structure (see FIGS. 3 and 4) to provide adequate stability. However, the faceoff practice device 102 can also be built using a tripod structure. Further, the faceoff practice device 102 may be built with a predefined height, or the faceoff practice device 102 may be built to allow for easy adjustment of its height, preferably ranging from 12 to 24 inches above the ice or floor surface where the device 102 is deployed for training. To allow height adjustment of the faceoff practice device 102, the legs 104 This flexibility may allow players 109 and 110 to practice faceoffs at their desired height preference. Various parts of the faceoff practice device 102 according to various embodiments are illustrated in conjunction with FIGS. 3-9.

Figure 3:
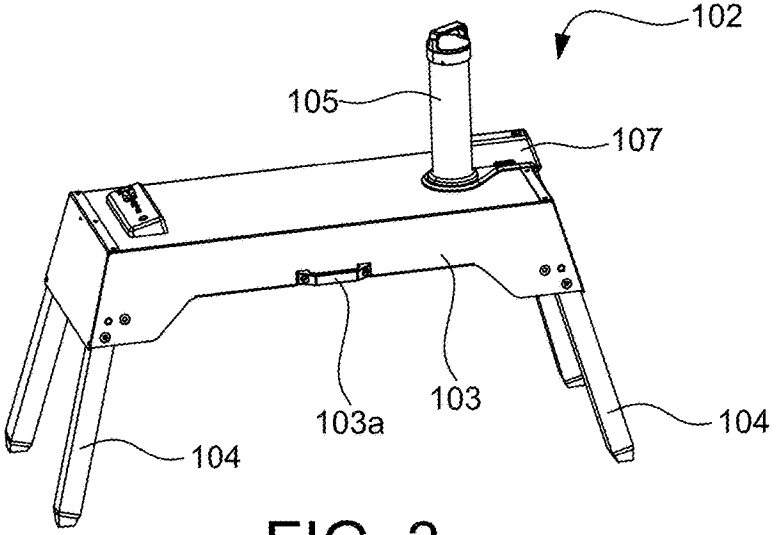
FIGS. 3-4 illustrates perspective views of a faceoff practice device of FIGS. 1 and 2.
Figure 4:
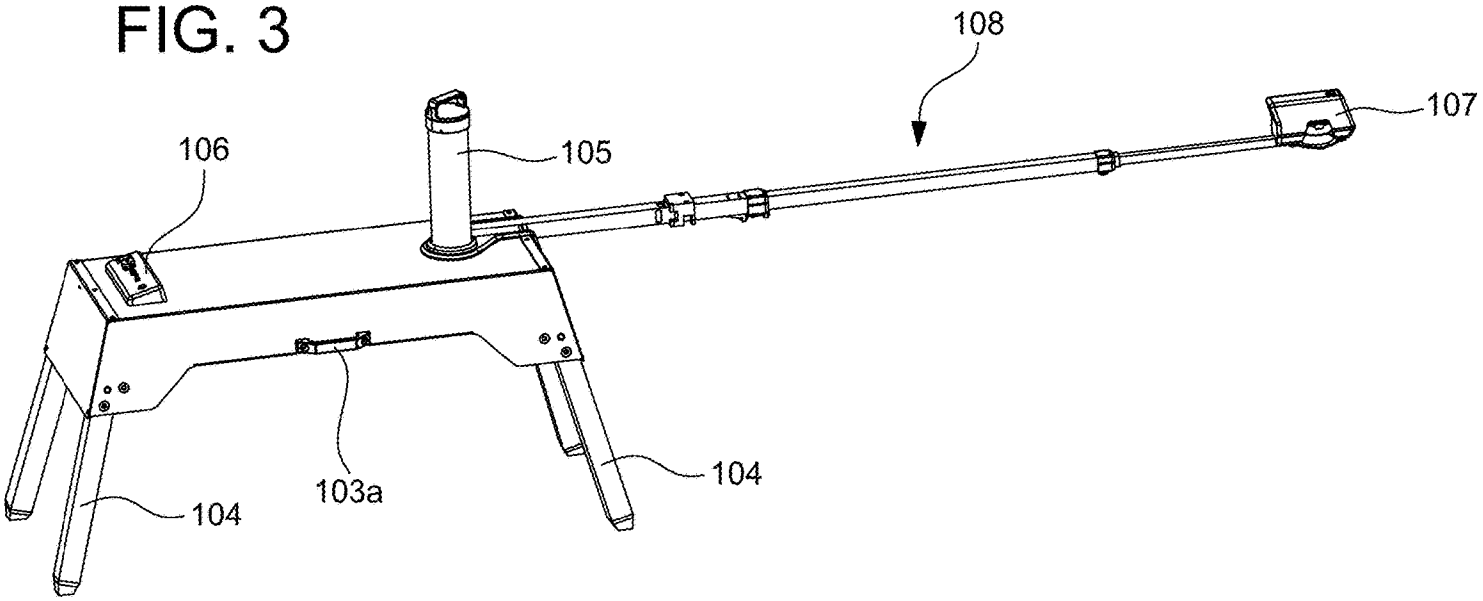

In an embodiment, as seen in FIGS. 3-4, the faceoff practice device 102 may include a cartridge or hopper-style feeder 105 capable of holding one or more pucks 112 there inside to ensure a constant supply of the pucks 112 during hockey faceoff training. Further, the faceoff practice device 102 includes a gripper hand 107 configured to hold at least one puck 112 that's later released between the players 109,110 involved in a face off training. Different parts of the gripper hand 107 are illustrated in conjunction with FIGS. 6 and 7 according to an embodiment of the present invention and in conjunction with FIG. 8 according to another embodiment. Further, the faceoff practice device 102 may include a means for pushing a single puck, for example, the puck 112 horizontally or vertically to ensure its availability for the gripper hand 107. Further, the faceoff practice device 102 may include an extendable arm 108 configured to move the gripper hand 107 at a threshold distance away from the cartridge or hopper-style feeder 105. Different parts of the extendable arm 108 are illustrated in conjunction with FIG. 4 and FIG. 9. Further, the faceoff practice device 102 includes a means for releasing the puck 112 after a full extension of the extendable arm 108. Further, the faceoff practice device 102 includes a means for retracting the extendable arm 108 after the release of the puck 104 from the gripper hand 107. The means may be an actuator (electrical or hydraulic) for example.

The extendable arm 108 extends outward from a body 103 of the faceoff practice device 102, typically spanning a distance of 2 to 5 feet (for example). This extension moves and places the gripper hand 107, located at the end of the arm 108, at a strategic position from the faceoff dot (point or location of faceoff), simulating real faceoff situations that occur at a distance from the boards or walls of an ice rink in real gameplay. The extendable arm 108 ensures smooth and secure extension and retraction for seamless operation. In an embodiment, the extendable arm 108 is telescopic in nature. The term "telescopic" in the context of the present invention refers to the arm being cylindrical sections or non-cylindrical sections that fit or slide into each other, so that it can be made longer or shorter, for example, to save space when it is not being used.

Figure 6:
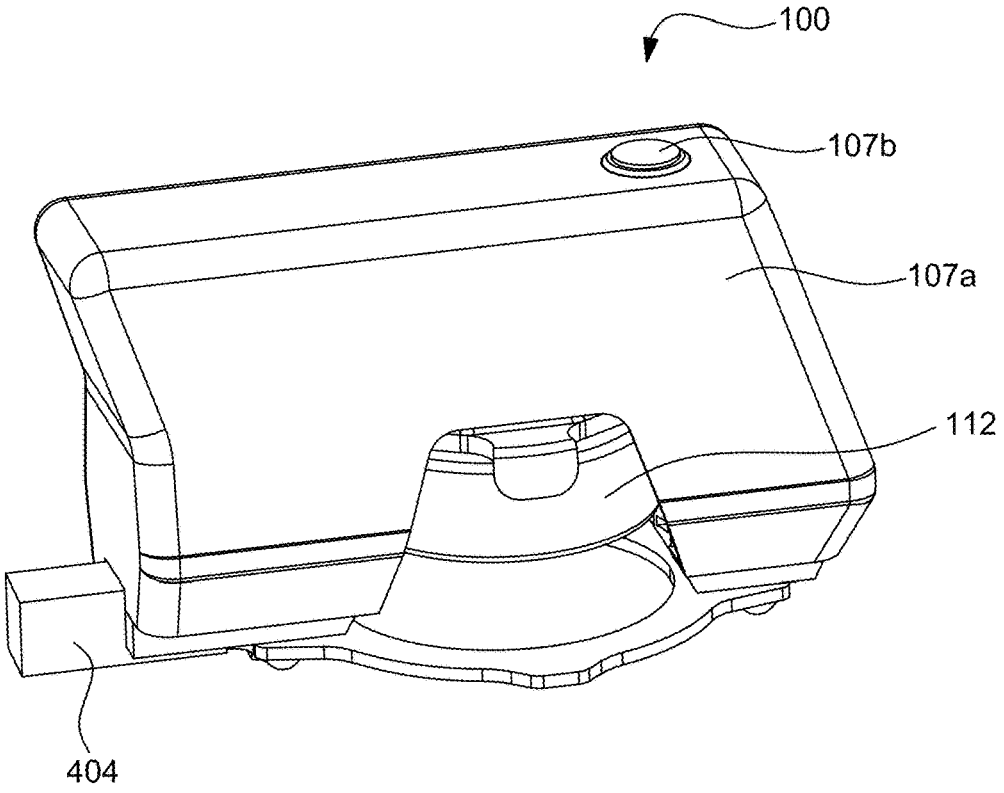
FIG. 6 illustrates a side view of a gripper hand of the faceoff practice device, according to an embodiment of the present invention.
Figure 7:
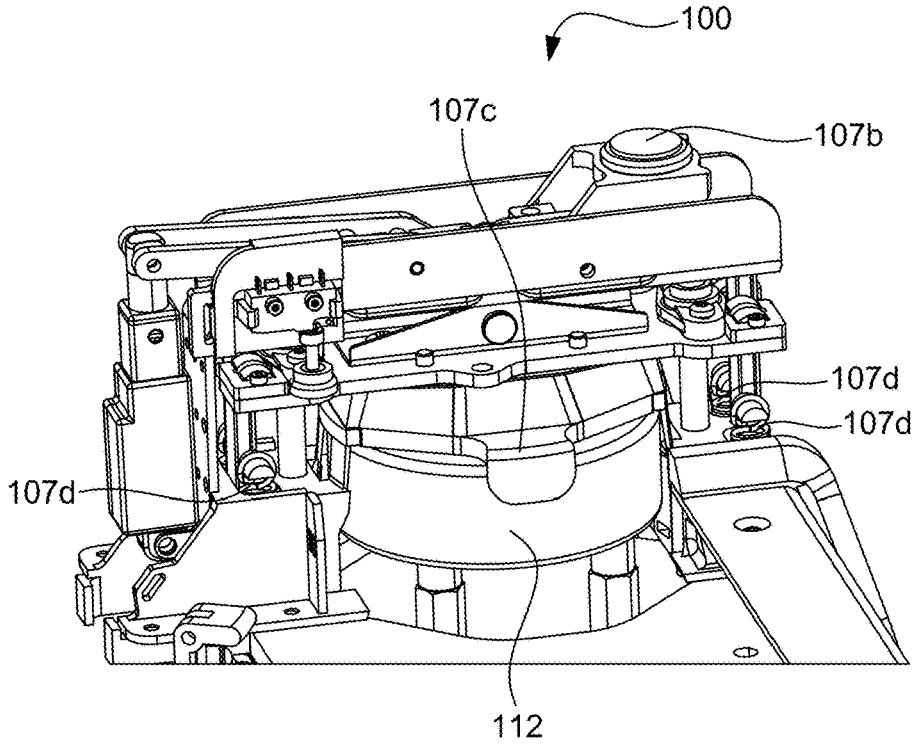
FIG. 7 illustrates a side view of the gripper hand of the faceoff practice device of FIG. 6 with an outer casing removed to reveal internal assembly, according to an exemplary embodiment of the present invention.
Figure 8:
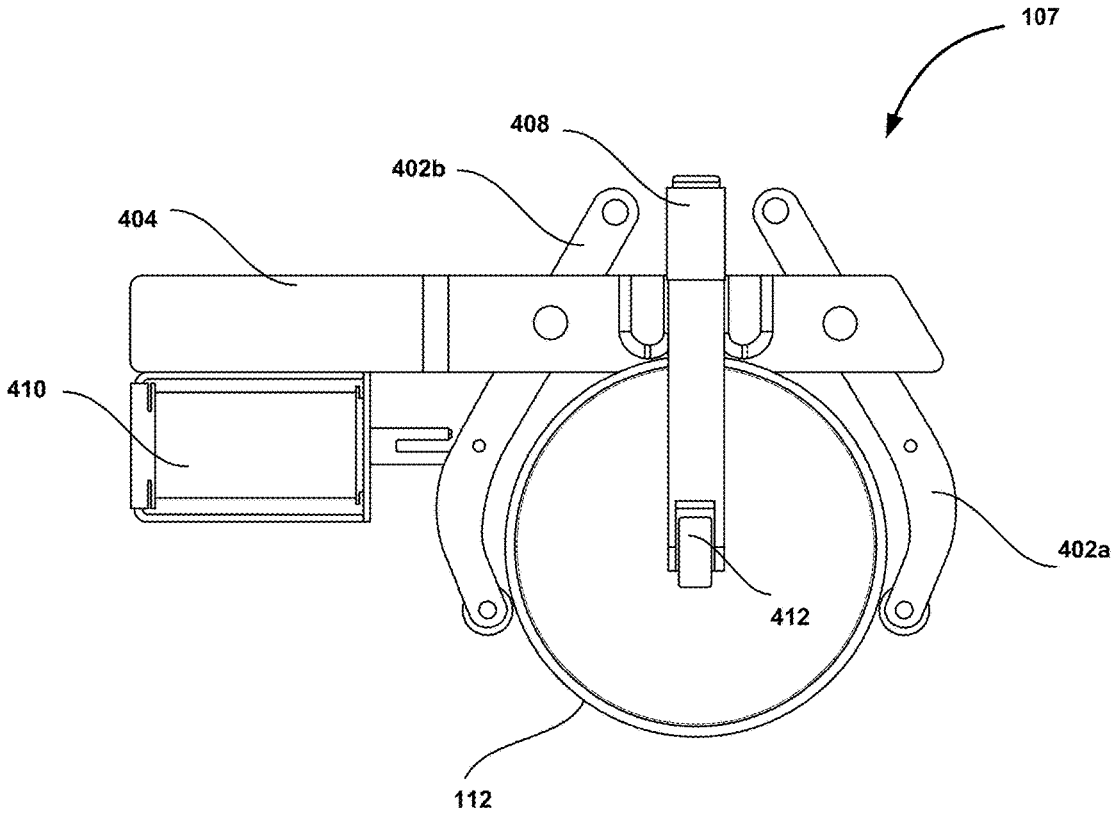
FIG. 8 illustrates a top view of the gripper hand of the faceoff practice device with the outer casing removed, according to another exemplary embodiment of the present invention.

The gripper hand 107 of the faceoff practice device 102 is equipped with a mechanism to hold and release the puck 112, for example, an ice hockey puck. As seen in FIGS. 6 and 7, the gripper hand 107 typically consists of a spring-loaded gripper 107*c* that securely picks, holds, and quickly releases the puck 112 when the faceoff practice device 102 is activated to function. The spring-loaded gripper 107*c* is operationally connected to springs 107*d* ensuring after releasing or dropping the puck the gripper regains its position to get ready to hold the next puck. The spring-loaded gripper 107*c* and associated components are all encased inside a casing 107*a*. The gripper hand 107 further comprises an indicator 107*b* that provides visual or auditory feedback to the user. It may include LED lights, a display screen, or speakers to indicate the device's status, mode selection, or countdown for puck releases. The indicator 107*b* enhances user/player experience by providing clear and intuitive information during training sessions. It helps players/users stay informed about the device's operation and ensures they are aware of the timing and status of puck 112 releases. In some other embodiment, the spring-loaded gripper 107*c* may take some different form and may be configured to include at least one fixed finger and one openable finger or can be connected via a linkage system as seen in FIG. 8. This configuration ensures a secure grip on the puck during the faceoff simulation. The gripper hand 107 can also be designed to accommodate interchangeability for different puck sizes or materials.

To introduce an element of unpredictability, the faceoff practice device 102 features a random release mechanism. Once the puck is loaded into the gripper hand (as seen in FIGS. 6-7 or FIG. 8), the arm 108 extends out of the body 103 of the device 102 to position the gripper hand 107 approximately 5 feet away from the faceoff dot. At a random interval of 1 to 4 seconds (for example) after full extension, the puck 112 is released from the gripper hand 107. This randomness replicates the dynamic nature of faceoff scenarios in the actual field of the game and helps the players 109 and 110 develop their timing and decision-making abilities.

Immediately after the puck 112 is released by the gripper hand 107, the extendable arm 108 quickly retracts back towards the body 103 to regain the start position, clearing the area for player interaction and enabling the gripper hand 107 to pick up another puck 112 for the next faceoff repetition from the feeder 105. This rapid retraction ensures a continuous and efficient training session, allowing players 109,110 to focus on their technique and reactions without unnecessary delays.

According to an embodiment, the faceoff practice device 102 provides two modes of operation: manual mode and an automatic mode. In the manual mode of operation, a user/trainer/coach (not shown) has full control over the release of individual pucks 112 out of the device 102. By pressing a button or activating a lever located over a use control panel 106, a single puck 112 is dispensed each time, allowing for precise and targeted drills. Further the control panel 106 may embody one or more buttons for manually changing device's settings, such as interval timing, randomization, and mode selection. In the automatic mode of operation, the faceoff practice device 102 is set to release pucks continuously at predetermined intervals of 5, 10, or 15 seconds for example depending upon preprogrammed instructions and depending upon the user's selection. Also, the device 102 may be programmed to adapt to changes in settings depending upon the players training outcomes or their performances. This mode provides a more dynamic training experience and facilitates drills that simulate real game conditions.

The faceoff practice device 102 has capacity to hold about 15 to 20 pucks inside the feeder 105, ensuring a sufficient number of repetitions during each training session. However, it should be understood that a feeder of any other size to hold more or less a number of pucks can be used. The hopper style feeder 105 as a component of the faceoff practice device 102 facilitates the loading and dispensing of multiple pucks and is designed to hold and store a significant number of pucks, allowing for continuous and uninterrupted faceoff drills. The exact design may vary depending on the specific implementation of the device 102, but the primary purpose remains consistent: to efficiently store and dispense the pucks for faceoff practice. It can be effectively used on various surfaces, including ice, concrete, asphalt, or wood. For ice surfaces, the device 102 (especially its legs 104) may be equipped with spikes to enhance stability and grip, while rubber grips are provided for other hard surfaces to prevent slippage and provide stability.

Furthermore, the faceoff practice device 102 may be made collapsible, lightweight, and easily transportable. It can be disassembled or folded into a compact form, making it convenient for storage and transportation to different training locations or ice rinks. The device's body 103 may be provided with one or more handles 103*a* to easily carry the device to different training locations or ice rinks. The lightweight construction ensures case of handling without compromising the device's stability and durability. Overall, the detailed design and functionality of the faceoff practice device 102 provide hockey players 109,110 with a realistic and customizable training tool, allowing them to improve their faceoff skills, timing, and decision-making abilities in a portable and versatile manner.

To enhance the faceoff practice device's capabilities and offer an immersive training experience, the faceoff practice device 102 may further include the integration of a smart app control system according to yet another embodiment. This system would enable users to interact with the faceoff practice device 102 using a computing device (not shown), for example, their smartphones or tablets. By connecting to the faceoff practice device 102 via Bluetooth or Wi-Fi, users will have full control over the device's settings, such as interval timing, randomization, and mode selection. The app would provide a user-friendly interface, and allow players 109 and 110 to customize their training sessions to meet their specific needs and preferences.

In the context of the present invention, the computing device refers to an electronic device that can be used to communicate over the communication network. Examples of computing devices include but are not limited to a cell phone, a smartphone, a cellular phone, a cellular mobile phone, a personal digital assistant (PDA), a personal computer, a server, a cloud-enabled device, a laptop, and a tablet computer. Examples of types of the communication network include but are not limited to a local area network, a wide area network, a radio network, a virtual private network, an internet area network, a metropolitan area network, a satellite network, Wi-Fi, Bluetooth Low energy, a wireless network, and a telecommunication network. Examples of the telecommunication network include, but are not be limited to a global system for mobile communication (GSM) network, a general packet radio service (GPRS) network, third Generation Partnership Project (3GPP), 4G, 5G, Long-Term Evolution (LTE), an enhanced data GSM environment (EDGE) and a Universal Mobile Telecommunications System (UMTS).

Additionally, the smart app could incorporate advanced features like video logging and sharing. The players 109 and 110 can record their faceoff drills directly through the app using their device's camera, capturing their technique and performance during training sessions. These videos may be logged within the app, creating a personalized training history that players 109, 110 can refer back to for self-assessment and improvement. Moreover, the app could provide a platform for sharing these videos with coaches, and teammates, or even on social media, facilitating feedback and interaction with a broader community of players and coaches.

Another implementation would be the introduction of a coaching subscription feature within the app. This feature would allow players 109 and 110 interested in availing training sessions to subscribe to coaching services provided by professional coaches or experienced players. Subscribers could access personalized feedback and analysis of their faceoff technique that they perform using the device 102, leveraging the recorded videos uploaded to the app. Coaches are able to provide detailed assessments, tips, and recommendations for improvement, assisting players 109,110 in refining their faceoff skills. This interactive coaching subscription would offer players valuable insights and guidance from experts, enhancing their development and progress.

By integrating smart app control, video logging, sharing capabilities, and coaching subscriptions, the faceoff practice device 102 would become a more comprehensive training system. This system would empower players to take their faceoff skills to the next level by leveraging modern technology, accessing personalized feedback, and fostering a sense of community and collaboration. The combination of hardware and software advancements would create a seamless and immersive training experience, bridging the gap between traditional training methods and digital innovations in the realm of ice hockey.

Figure 5:
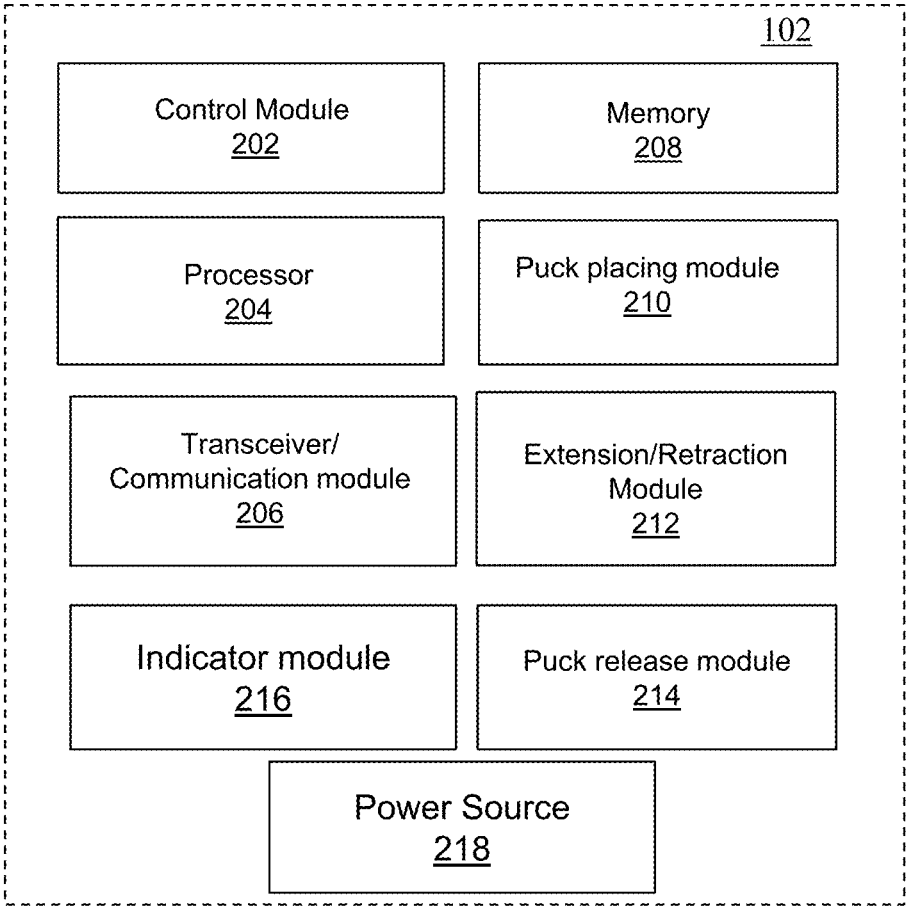
FIG. 5 is a block diagram that illustrates various functional modules of the faceoff practice device of FIGS. 3-4, according to an embodiment of the present invention.

FIG. 5 is a block diagram 200 illustrating various functional modules inherent within the faceoff practice device 102, according to an embodiment of the present invention. The block diagram 200 shows that internally the device 102 includes a control module 202, a processor 204, a communication module 206, an indicator 216, a puck release module 214, an extension/retraction module 212, a memory 208, a power source 218, and a puck placing module 210. The control module 202 of the faceoff practice device 102 is responsible for managing the overall operation and functionality of the faceoff practice device 102. It includes hardware components and software programming that enable user interaction and control. The control module 202 (or control panel 106) may consist of buttons, switches, or a touchscreen interface that allows users to select modes, adjust settings, and initiate actions such as manual puck releases. The control module 202 receives input from the user and communicates with other modules to execute the desired commands to make the device 102 functional.

The processor 204 serves as the brain of the faceoff practice device 102. It is responsible for processing instructions, performing calculations, and coordinating the actions of different modules. The processor 204 interprets user commands from the control module 202, controls the timing and sequencing of puck releases, and manages the overall functionality of the faceoff practice device 102. The processor 204 ensures smooth operation and efficient coordination between the various modules.

The communication module 206 enables connectivity and data exchange between the faceoff practice device 102 and external devices or systems. It may utilize Bluetooth or Wi-Fi technology to establish wireless communication with a smartphone or tablet for app control or video logging/sharing features. The communication module 206 also facilitates data transfer to and from a coaching subscription service if applicable. The communication module 206 ensures seamless interaction between the faceoff practice device 102 and external devices or platforms.

The puck release module 214 is responsible for securely holding and releasing the hockey pucks during faceoff practice drills. The puck release module 214 consists of a gripper hand 107 or mechanism that can firmly grip the puck and release it at the desired time. The puck release module 214 is synchronized with the timing control from the processor 204 to ensure accurate and consistent releases. The puck release module 214 ensures that the puck is dropped in a randomized manner, simulating game-like faceoff scenarios.

The extension/retraction module 212 controls the movement of the extendable arm 108, which positions the gripper hand 107 at the desired distance from the faceoff dot. The extension/retraction module 212 extends the extendable arm 108 to the predetermined distance to place the gripper hand 107 in the optimal position for faceoff simulations. After the puck release, the extension/retraction module 212 quickly retracts the extendable arm 108 back to the start position to prepare for the next puck pick-up. This ensures smooth and swift movements for efficient training sessions.

The puck placing module 210 is responsible for accurately positioning the pucks within the device 102 for loading into the gripper hand 107 from the feeder 105. The puck placing module 210 includes the hopper-style feeder 105 that can hold and dispense multiple pucks as discussed above. The puck placing module 210 ensures that the pucks are placed in a ready position, ready to be pushed into the gripper hand 107 for each faceoff repetition. The puck placing module 210 provides a reliable and efficient mechanism for loading and positioning the pucks within the device.

The memory 208 stores and retrieves data related to the faceoff practice device's operation and user preferences. It may include non-volatile memory to retain settings, interval timing, and other user-defined configurations even when the device is powered off. The memory 208 may also store recorded videos for video logging/sharing features. It allows for the preservation of data and settings, providing a personalized and consistent experience for users.

The indicator module 216 (also referred to as 107*b* on the gripper hand 107) provides visual or auditory feedback to the user. It may include LED lights, a display screen, or speakers to indicate the device's status, mode selection, or countdown for puck releases. The indicator module 216 enhances user experience by providing clear and intuitive information during training sessions. It helps users stay informed about the device's operation and ensures they are aware of the timing and status of puck releases.

The power source module 218 is responsible for powering up the device 102. The power source 218 is preferably one or more batteries. In certain practice locations where an external power source may not be readily available, the proposed device is going to be very handy as players/coaches don't have to rely on external power sources. The device 102 is capable of being a plug and play device.

Each module of the faceoff practice device 102 plays a crucial role in delivering a seamless, user-friendly, and effective training experience. The integration and coordination of these modules ensure precise puck releases, proper timing, user control, and feedback, contributing to the overall functionality and performance of the device.

With respect to operation, the feeder mechanism feeds pucks one at a time into the gripper hand 107 or puck release module 214. This ensures a controlled and sequential release of pucks during the training session. As one puck is released, the feeder 105 automatically moves the next puck into position, ready for the next repetition.

The feeder mechanism may incorporate various mechanisms to ensure proper puck alignment and dispensing.

These mechanisms can include spring-loaded arms, ramps, or conveyor belt systems that push the pucks into position as needed. The goal is to provide a reliable and consistent method of loading and positioning the pucks for each faceoff repetition. The hopper-style feeder 105 adds convenience and efficiency to the faceoff practice device 102 by eliminating the need for manual puck reloading after each repetition. It allows players 109 and 110 to focus on their training without interruptions, as the feeder automatically feeds the pucks at a predetermined interval, aligning with the randomized release mechanism of the gripper hand.

Next, the gripper hand 107 comes into action and is configured to hold at least one puck, Different parts of the gripper hand 107 according to embodiments are illustrated in conjunction with FIGS. 7 and 8. Next, as shown in FIGS. 1 and 4, the extendable arm 306 comes into action and is a crucial component of the faceoff practice device 102 that allows for precise positioning of the gripper hand 107 at a specific distance from the hopper style feeder 105. It is designed to extend and retract, enabling the gripper hand 107 to reach the desired location for puck placement during training sessions.

The extendable arm 108 is typically telescopic in nature, consisting of multiple sections or segments that can slide into one another. This telescoping mechanism provides flexibility in adjusting the length of the arm 108 according to the desired placement distance. By extending or retracting the arm 108, the gripper hand 107 can be positioned at a threshold distance from the cartridge or hopper-style feeder 105, ensuring optimal puck pickup and release. The arm's 108 extension capability is controlled by the device's mechanism, usually driven by one or more motors or actuators. When activated, the motor extends the arm, pushing the sections outward to reach the desired length. The extendable arm 108 remains stable and rigid once fully extended.

The threshold distance is predetermined and set based on the specific requirements of the faceoff practice drills. It ensures that the gripper hand 107 is placed at a suitable distance from the hopper style feeder 105, allowing for smooth and efficient puck transfer. This distance may vary depending on factors such as the size of the device, the dimensions of the training area, and the desired puck release trajectory. The extendable arm's retracting capability is equally important. After the puck is released, the extendable arm 108 retracts swiftly and smoothly, clearing the area for player interaction and preparing for the next puck pickup. This retraction movement is controlled by the device's mechanism, which pulls the telescopic sections of the arm 108 back into their original position. The extendable arm 108 enhances the functionality and versatility of the faceoff practice device by enabling precise puck placement at a threshold distance. It ensures that the gripper hand 107 is correctly positioned for effective faceoff simulations and provides consistent and reliable training experiences. The ability to extend and retract the arm allows for efficient training sessions, saving time and facilitating seamless repetition of faceoff drills.

Furthermore, the faceoff practice device 102 includes a control panel 106. consisting of buttons, switches, or a touchscreen interface that allows users to select modes, adjust settings, and initiate actions such as manual puck releases. Additionally, the faceoff practice device 102 may include adjustable legs 104 according to an embodiment. The faceoff practice device 102 may include nonadjustable legs 104 according to another embodiment. These adjustable legs 104 are likely to be a tripod structure or four-legged structure. The tripod or four-legged structure is an integral part of the faceoff practice device 102, providing stability and adjustability in terms of the device's height above the ice or floor surface. It is designed to support the entire device 102 while allowing users to customize the height according to their specific training needs.

The legs 310 are typically made of durable materials such as metal or reinforced plastic to provide strength and support. Each leg may have adjustable sections that allow for height customization. The height adjustability feature of the tripod or four legged structure is essential for accommodating different training scenarios and player preferences. The device 102 can be raised or lowered within a range of 12 to 24 inches above the ice or floor surface according to one embodiment.

The tripod or four-legged structure's height adjustment mechanism can vary depending on the specific design of the faceoff practice device 102. It may include telescopic legs with locking mechanisms that may allow users to extend or retract the legs to the desired height. Alternatively, the legs may have multiple pre-set height positions that can be easily selected. The ability to raise or lower the device's height provides several advantages. For instance, it may allow players to practice faceoffs from different positions, such as standing, crouching, or kneeling, as they would in an actual game. This versatility helps players develop their skills in various stances and adapt to different faceoff scenarios. Furthermore, the height adjustment feature ensures that the device 102 is suitable for players of different ages, heights, and skill levels. Younger players or those with limited mobility can set the device at a lower height to ensure comfortable and effective practice sessions. More experienced players may prefer a higher setting to challenge themselves and enhance their faceoff techniques.

The tripod or four-legged structure's stability is of utmost importance to ensure safe and consistent training. It provides a sturdy foundation for the device 102, minimizing vibrations or wobbling during faceoff drills. The legs 104 of the tripod structure are positioned in a way that distributes the weight evenly and prevents the device 102 from tipping over during intense training sessions.

FIG. 4 illustrates the top view of the gripper hand 304 of the faceoff practice device 102, according to an embodiment of the present invention. The gripper hand 304 is a key component of the faceoff practice device 102 that is responsible for securely holding and releasing the hockey pucks, for example, puck 406 during training sessions. It is designed to mimic the hand's grasping motion, providing a reliable grip on the pucks for accurate and controlled releases.

FIGS. 7 and 8 show common configurations of the gripper hand 107 according to various embodiments. Although the configurations are already discussed briefly above, the configuration for the gripper hand 107 as shown in FIG. 8 includes at least one fixed finger, for example, finger 402*a*, and one openable finger, for example, finger 402*b*. The fixed finger remains stationary and provides a stable support for the puck 112. The openable finger is designed to move or pivot, allowing for the insertion and removal of the puck 112. This configuration enables easy loading of the puck 112 into the gripper hand 107 and ensures a secure hold during the faceoff practice. The openable finger can be operated using various mechanisms such as a hinge, a spring-loaded mechanism, or an actuator 410. When the gripper hand 107 is in the closed position, the openable finger tightly grips the puck 406 against the fixed finger, preventing it from slipping or moving prematurely.

To release the puck 112, the openable finger is activated, creating a gap or space between the fingers, for example, fingers 402*a* and 402*b*. This controlled opening of the grip allows the puck 112 to be released from the gripper hand 107 and drop onto the ice surface. The timing of the finger movement is coordinated with the overall device's operation, ensuring that the puck is released at the desired moment.

Alternatively, the gripper hand 107 may employ a linkage system that connects the fingers. In this configuration, the fingers are mechanically linked together, allowing for synchronized movement. When the grip is closed, both fingers move toward each other to secure the puck 112. When the grip is opened, the fingers move away from each other to release the puck. The gripper hand 107 is typically designed with materials that provide sufficient friction and grip strength to securely hold the puck without causing damage. Rubber or textured surfaces may be incorporated to enhance the grip and prevent the puck from slipping or sliding within the gripper hand 107.

The fingers of the gripper hand 107 are preferably solenoid-controlled fingers responsible for releasing the puck 112 from the grip. A solenoid is an electromagnetic device that, when energized, generates a magnetic field to exert force on its internal components. In this case, the solenoid is used to actuate the fingers, causing them to open or close as needed. When the solenoid is triggered, it creates a magnetic field that activates the fingers, allowing them to release their grip on the puck. This controlled release ensures that the puck is released in a consistent and controlled manner, providing accuracy during faceoff practice. The solenoid-controlled fingers provide a reliable and precise mechanism for releasing the puck when triggered by the device's internal system.

Furthermore, as seen in FIG. 8, the gripper hand 107 may include a spring-loaded upper finger 408 that serves to induce downward force on the puck 112 when released. This downward force helps stabilize the puck 112 during the release process, ensuring that it maintains contact with the playing surface and preventing it from bouncing or rolling unpredictably. The spring-loaded upper finger 408 exerts pressure on the top of the puck 112, applying downward force as it is released from the gripper hand 107. This force helps keep the puck in contact with the ice or floor surface, minimizing erratic behaviour and promoting more realistic faceoff simulations. The spring-loaded mechanism allows for consistent and controlled pressure, ensuring a stable puck release. Another feature of the gripper hand 107 is the inclusion of a cam roller 412 on the upper finger 408. The cam roller 412 is designed to roll to a random position with each loading and introduces a random tilt to the puck during ejection. As the gripper hand 107 is loaded with a new puck, the cam roller 412 rotates to a different position, altering the orientation and tilt of the upper finger 408. This random tilt introduces an element of unpredictability to the puck's trajectory when it is released. It mimics real-game scenarios where the puck may have slight variations in its angle or orientation, challenging players to adapt and react quickly during faceoff practice.

By incorporating the cam roller 412 feature, the gripper hand 107 adds an element of realism to the faceoff training experience. It introduces slight variations in the way the puck is released, promoting player adaptability and improving their ability to respond to different puck angles and trajectories.

Furthermore, as seen in FIG. 8, the gripper hand 107 of the faceoff practice device 102 features a shaft 404 that serves as a connection point between the gripper hand 107 and the extendable arm 108. The shaft 404 is also seen in the embodiment of the hand gripper 107 shown in FIGS. 6-7. The shaft 404 acts as a link, enabling the secure attachment and seamless integration of the gripper hand 304 with the extendable arm 108. The shaft 404 is a cylindrical component that provides structural support and stability to the gripper hand 107. It is designed to align with the extendable arm 108, allowing for a smooth and reliable connection between the two components. The shaft 404 is typically made of sturdy and durable material, such as metal or reinforced plastic, to withstand the forces exerted during faceoff practice. By connecting the gripper hand 107 to the extendable arm 108 through the shaft 404, the entire assembly remains robust and rigid during training sessions. This connection ensures that the gripper hand 107 maintains a stable position and alignment relative to the extendable arm 108, allowing for precise puck placement and controlled releases.

The shaft 404 facilitates the transfer of motion and force between the gripper hand 107 and the extendable arm 108. As the extendable arm 108 extends or retracts, the shaft 404 enables the gripper hand 107 to move accordingly, positioning it at the desired distance from the cartridge or hopper-style feeder 105. This coordinated movement ensures accurate puck pickups and releases during faceoff drills.

Figure 9:
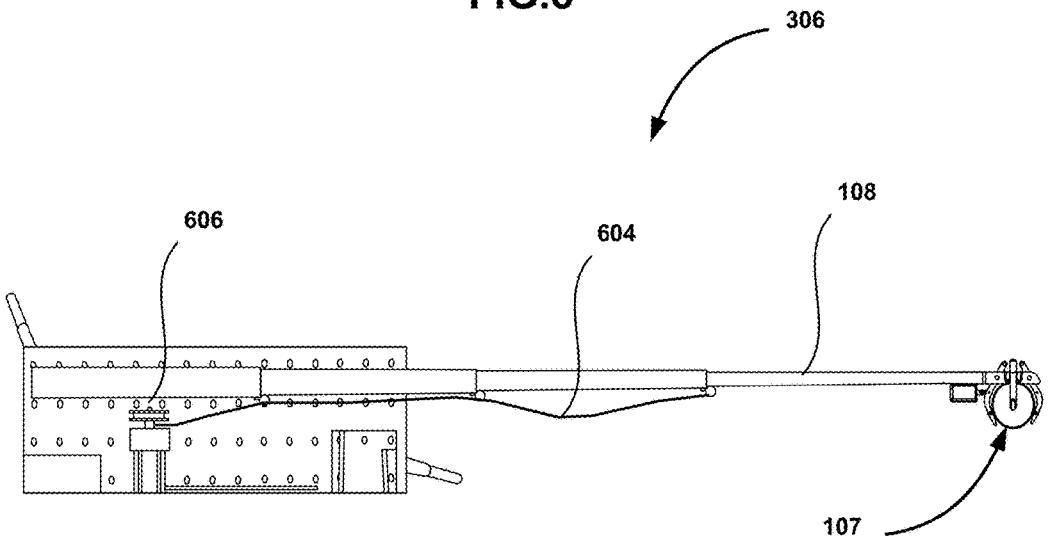
FIG. 9 illustrates the extendable arm of the faceoff practice device, according to one example embodiment of the present invention.

FIG. 9 illustrates the extendable arm 108 of the faceoff practice device 102, according to an embodiment of the present invention. The extendable arm 108 is designed to extend the gripper hand 107 to a distance of approximately 5 feet, reaching the designated faceoff area. This extension allows for realistic placement of the gripper hand 107 and the subsequent release of the puck 112 in the desired location. By extending the arm 108 to this specific length, the device 102 can accurately replicate faceoff scenarios and provide players with an authentic training experience. Immediately after the puck drop, the extendable arm 108 rapidly retracts to clear the area for puck interaction. This swift retraction ensures that the arm does not obstruct the players or interfere with their ability to engage with the puck. Clearing the area promptly allows for uninterrupted practice sessions and enables players to quickly react to the puck's movement. To control the extension and retraction of the extendable arm 108, a system of cables 604 and motor/pulley mechanism is employed according to an embodiment. The cables 604 are connected to the extendable arm 108 and run through pulleys, which are driven by a motor 606. The motor 606 controls the speed and direction of the cables, facilitating smooth and precise movement of the extendable arm 306.

By utilizing the motor/pulley mechanism according to an embodiment, the device's internal system can regulate the extension and retraction speed of the telescopic arm 108. This control ensures consistent and controlled movement, enhancing the accuracy and reliability of the faceoff practice device. Players can rely on the predictable extension and retraction of the arm 108, enabling them to focus on their training without distractions or disruptions.

Figure 10:
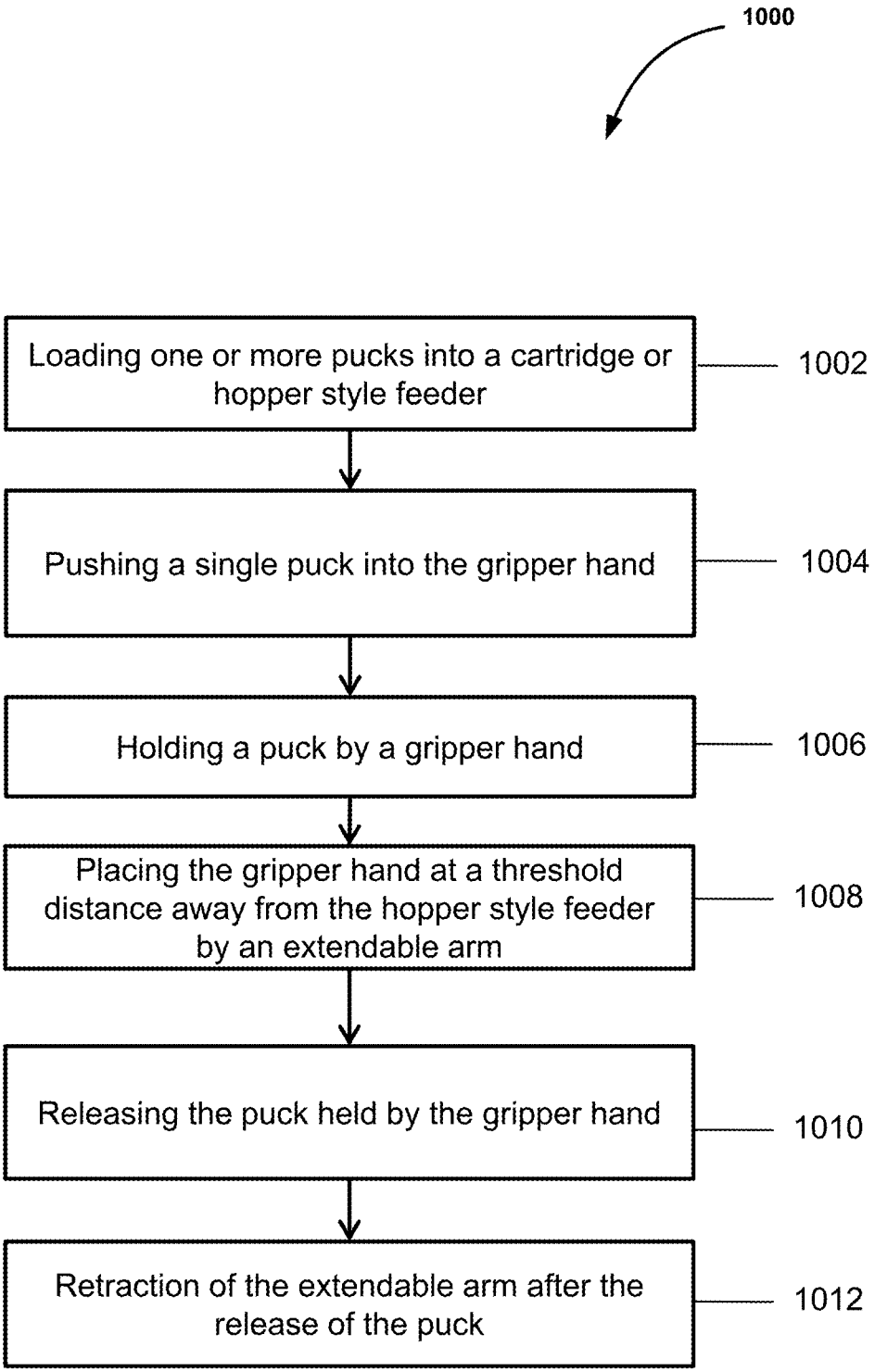
FIG. 10 illustrates a flow diagram of a method for dropping a puck in between two players during a hockey face-off training, according to an exemplary embodiment of the present invention.

FIG. 10 illustrates a flow diagram 1000 of the method of dropping the puck 112 between the players to facilitate, simulate, or train them for face-off, according to an exemplary embodiment of the present invention. At step 1002, the method includes loading the one or more pucks into the cartridge or hopper-style feeder 105.

Next, at step 1004, the method includes a step of pushing the single puck into the gripper hand 107. At step 1006, the method includes holding at least one puck by the gripper hand 107. At step 1008, the method includes moving and placing the gripper hand 107 at a threshold distance away from the cartridge or hopper-style feeder 302 utilizing the extendable arm 108 connected to the gripper hand 107.

Next, at step 1010, the method includes releasing of the puck 112 after full extension of the extendable arm 108. Next, at step 1012, the method includes retracting the extendable arm 108 back towards the device 102 after the release of the puck.

The various actions, acts, blocks, steps, or the like in the flow diagram may be performed in the order presented, in a different order, or simultaneously. Further, in some embodiments, some of the actions, acts, blocks, steps, or the like may be omitted, added, modified, skipped, or the like without departing from the scope of the invention.

The proposed invention provides many advantages over the existing methods and systems. The proposed device is lightweight and portable, allowing easy transportation, and ease of carrying in various training environments, including ice rinks, training facilities, and even at home. Further, by introducing randomness and unpredictability, the device provides a more realistic training experience to players, and helps them develop faceoff skills in game-like conditions. Further, the device offers adjustable parameters, enabling players to tailor the training experience to their specific needs, skill level, and desired level of challenge. Further, the automated puck-dropping mechanism eliminates the need for manual intervention, saving time and enabling players to focus solely on their technique and decision-making.

The proposed hockey puck face-off method and portable device represent a significant advancement in the field of ice hockey training equipment by overcoming the limitations of previous bulky and non-portable devices.

Although particular embodiments of the invention have been described in detail for purposes of illustration, various modifications and enhancements may be made without departing from the spirit and scope of the invention.

What is claimed is:

1. A hockey faceoff practice device (102), comprising:

a hopper-style feeder (105) capable of holding one or more hockey pucks (112) there inside, wherein the hopper-style feeder (105) ensures a constant supply of the hockey pucks (112) during a hockey faceoff training;

a gripper hand (107) configured to pick and hold a hockey puck (112) of the one or more hockey pucks (112) supplied from the hopper-style feeder (105), and release of the puck (112) in a randomized manner after being extended to a threshold distance away from the hopper style feeder (105) or the hockey faceoff practice device (102); and a means for retracting the gripper hand (107) back to the hockey faceoff practice device (102) after the release of the puck (112).

2. The hockey faceoff practice device (102) of claim 1, wherein the puck (112) fed to and held by the gripper hand (107) is loaded therein (107) by a puck placing module (210).

3. The hockey faceoff practice device (102) of claim 1, wherein the puck (112) held by the gripper hand (107) is released by a puck release module (214) in synchronization with timing control from a processor (204) in communication with a control module (202 or 106) configured on the hockey faceoff practice device (102).

4. The hockey faceoff practice device (102) of claim 1, wherein the gripper hand (107) is extended to the threshold distance away from the hopper style feeder (105) or the desired distance from a faceoff dot utilizing an extendable arm (108).

5. The hockey faceoff practice device (102) of claim 4, wherein the extendable arm (108) is extendable via cables and motor/pulley mechanisms to control the speed of extension/retraction of the extendable arm (108).

6. The hockey faceoff practice device (102) of claim 1, wherein the means comprises at least one of: an actuator, and a motor.

7. The hockey faceoff practice device (102) of claim 1, wherein the hockey faceoff practice device (102) is adapted to operate in at least one of:

a manual mode allowing dispensing of a single puck (112) upon pushing a button present on the control module (202 or 106), and an automatic mode enabling continuous dispensing of the pucks (112) at time intervals selectable by a user.

8. The hockey faceoff practice device (102) of claim 1, wherein the hockey faceoff practice device (102) comprises a tripod structure and/or a four-legged structure.

9. The hockey faceoff practice device (102) of claim 7, wherein the tripod structure and/or a four-legged structure comprises fixed length legs or height adjustable legs.

10. The hockey faceoff practice device (102) of claim 1, wherein the gripper hand (107) comprises a spring-loaded gripper (107*c*) configured to securely pick, hold, and release the puck (112) when the faceoff practice device (102) is activated to function.

11. The hockey faceoff practice device (102) of claim 1, wherein the gripper hand (107) comprises at least one fixed finger (402*a*), and at least one openable finger (402*b*).

12. The hockey faceoff practice device (102) of claim 11, wherein the at least one fixed finger (402*a*) remains stationary and provides a stable support for the puck (112) held by the gripper hand (107), and the at least one openable finger (402*b*) is configured to move or pivot, allowing for loading, and release of the puck (112) in the gripper hand (107).

13. The hockey faceoff practice device (102) of claim 11, wherein the at least one fixed finger (402*a*) and the at least one openable finger (402*b*) of the gripper hand (107) are solenoid-controlled fingers.

14. The hockey faceoff practice device (102) of claim 11, wherein the gripper hand (107) comprises a spring-loaded upper finger (408) to induce a downward force on the puck (112) when released.

15. The hockey faceoff practice device (102) of claim 14, wherein the upper finger (408) is connected to a cam roller (412) that rolls to a random position with each loading of the puck (112).

16. The hockey faceoff practice device (102) of claim 1 wherein, the gripper hand (107) comprises an indicator 107*b* configured to provide visual or auditory feedback to the user to indicate the device's status, mode selection, or countdown for puck releases.

17. The hockey faceoff practice device (102) of claim 1, wherein the extendable arm (108) is configured to extend the gripper hand (107) to a distance spanning from 2 feet to 5 feet.

18. The hockey faceoff practice device (102) of claim 1, wherein the faceoff practice device (102) is made to operate as an application control system operated using a user computing device.

19. A method for hockey faceoff training using a hockey faceoff practice device (102), comprising the steps of:

loading one or more pucks (112) into a hopper-style feeder (105) located on a body of the hockey faceoff practice device (102);

picking and holding of at least one puck (112) by a gripper hand (107) supplied from the hopper-style feeder (105);

pushing a single puck (112) into the gripper hand (107) for a secure holding;

moving and placing the gripper hand (107) at a threshold distance away from the hopper-style feeder (105) by an extendable arm (108);

releasing the puck (112) securely held by the gripper hand (107) after full extension of the extendable arm (107); and retraction of the extendable arm (108) back into the hockey faceoff practice device (102) after the release of the puck (112).

20. The method of claim 19, wherein the threshold distance spans from 2 feet to 5 feet.

* * * * *